US009532915B1

(12) United States Patent
McKinney

(10) Patent No.: US 9,532,915 B1
(45) Date of Patent: Jan. 3, 2017

(54) MIGRAINE HELMET

(71) Applicant: Michelle McKinney, Tampa, FL (US)

(72) Inventor: Michelle McKinney, Tampa, FL (US)

( * ) Notice: Subject to any disclaimer, the term of this patent is extended or adjusted under 35 U.S.C. 154(b) by 731 days.

(21) Appl. No.: 13/781,588

(22) Filed: Feb. 28, 2013

Related U.S. Application Data

(63) Continuation-in-part of application No. 12/405,321, filed on Mar. 17, 2009, now abandoned.

(60) Provisional application No. 61/069,755, filed on Mar. 17, 2008.

(51) Int. Cl.
*A61H 1/00* (2006.01)
*A61H 15/00* (2006.01)
*A61H 7/00* (2006.01)

(52) U.S. Cl.
CPC ..... *A61H 1/00* (2013.01); *A61H 7/006* (2013.01); *A61H 15/0078* (2013.01); *A61H 2015/0028* (2013.01); *A61H 2201/1604* (2013.01); *A61H 2205/021* (2013.01)

(58) Field of Classification Search
CPC ..... A61H 7/006; A61H 2205/021; A61H 2201/1604; A61H 2201/1607; A61H 15/0075; A61H 1/00; Y10S 601/15
USPC ..... 601/12, 15, 70, 84, 93, 95, 103, 108; 4/519, 516, 518
See application file for complete search history.

(56) References Cited

U.S. PATENT DOCUMENTS 5,557,807 A * 9/1996 Hujar ..... A42B 1/008 2/171.2
7,153,283 B1 * 12/2006 Triolo ..... A61H 15/0078 601/102
2005/0267388 A1 * 12/2005 Hanna ..... A61H 23/02 601/70
2008/0184456 A1 * 8/2008 Fontanez ..... A42C 5/04 2/171.3
2009/0231276 A1 * 9/2009 Ullrich ..... G06F 3/016 345/157

* cited by examiner

*Primary Examiner* — Kari Petrik
(74) *Attorney, Agent, or Firm* — Kenneth L Tolar

(57) ABSTRACT

A migraine helmet includes a hollow, spherical shell having an exterior surface, an interior surface that defines a head cavity, a face opening and a neck opening. On the interior surface of the shell are multiple, motorized massaging units positioned to engage a wearer's temples and the nape of the neck. A pair of gel packs are removably attached to the interior surface of the shell for cooling the head to further ease painful symptoms associated with migraine headaches. A separable chin strap depends from each of two lower edges of the shell for securing the helmet to the wearer.

8 Claims, 2 Drawing Sheets

MIGRAINE HELMET

CROSS REFERENCE TO RELATED APPLICATIONS

This application is a continuation-in-part of application Ser. No. 12/405,321, which claimed the benefit of provisional application No. 61/069,755 filed on Mar. 17, 2008, the specifications of which are incorporated herein by reference.

BACKGROUND OF THE INVENTION

The present invention relates to a therapeutic helmet primarily designed for migraine sufferers.

DESCRIPTION OF THE PRIOR ART

Many people suffer from recurring migraine headaches, which can be debilitating and disruptive. Though numerous migraine medications exist, they are expensive and often cause a myriad of side effects. Cryotherapy, i.e., therapeutically treating injuries by cooling or chilling, has long been recognized as an effective means of relieving headaches. However, holding an ice pack on one's head is cumbersome and occupies at least one hand that could otherwise be used for other tasks. Furthermore, massaging the neck and scalp often relieves many of the irritating symptoms associated with migraine headaches.

Accordingly, there is currently a need for a safer and more convenient means of relieving headaches. The present invention addresses this need by providing a helmet having motorized massage units and a pair of freezable gel packs removably positioned within the interior that allow the wearer to immediately relieve headaches.

SUMMARY OF THE INVENTION

The present invention relates to a migraine helmet comprising a hollow, spherical shell having an exterior surface, an interior surface that defines a head cavity, a face opening and a neck opening. On the interior surface of the shell are multiple, motorized massaging units strategically positioned to engage a wearer's temples and the nape of the neck. A pair of gel packs are removably attached to the interior surface of the shell for cooling the head to further ease painful symptoms associated with migraine headaches. A separable chin strap depends from each of two lower edges of the shell for securing the helmet to the wearer.

It is therefore an object of the present invention to provide a helmet that provides relief to headache sufferers.

It is another object of the present invention to provide a helmet that includes multiple, motorized massaging units for relieving tension caused by severe headaches.

It is yet another object of the present invention to provide a helmet having detachable, freezable gel packs for chilling a wearer's head.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
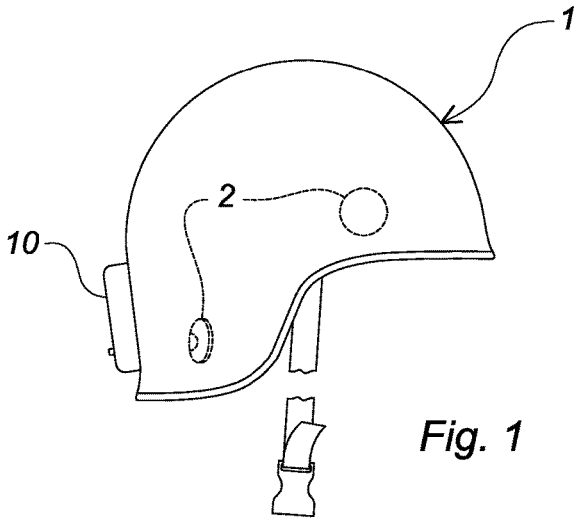
FIG. 1 is a side, plan view of the helmet according to the present invention.
Figure 2:
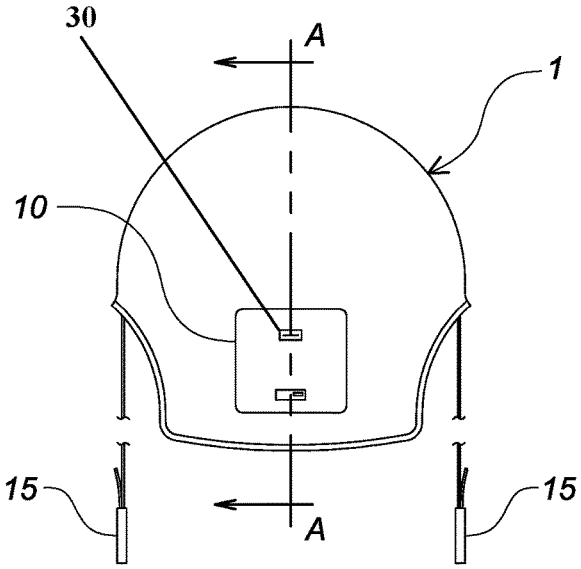
FIG. 2 is a rear view of the helmet.
Figure 3:
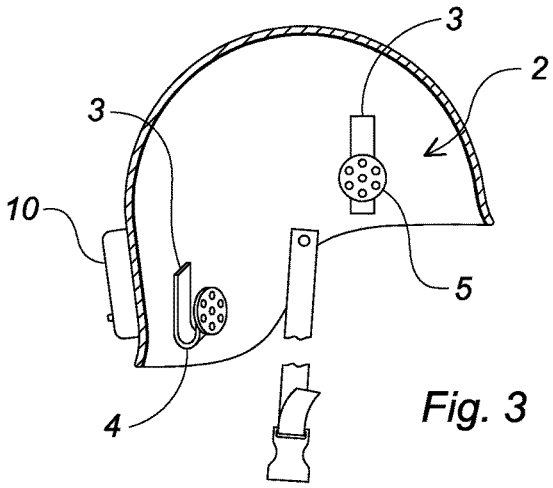
FIG. 3 is a sectional view of the helmet taken along line A-A in FIG. 2.
Figure 4:
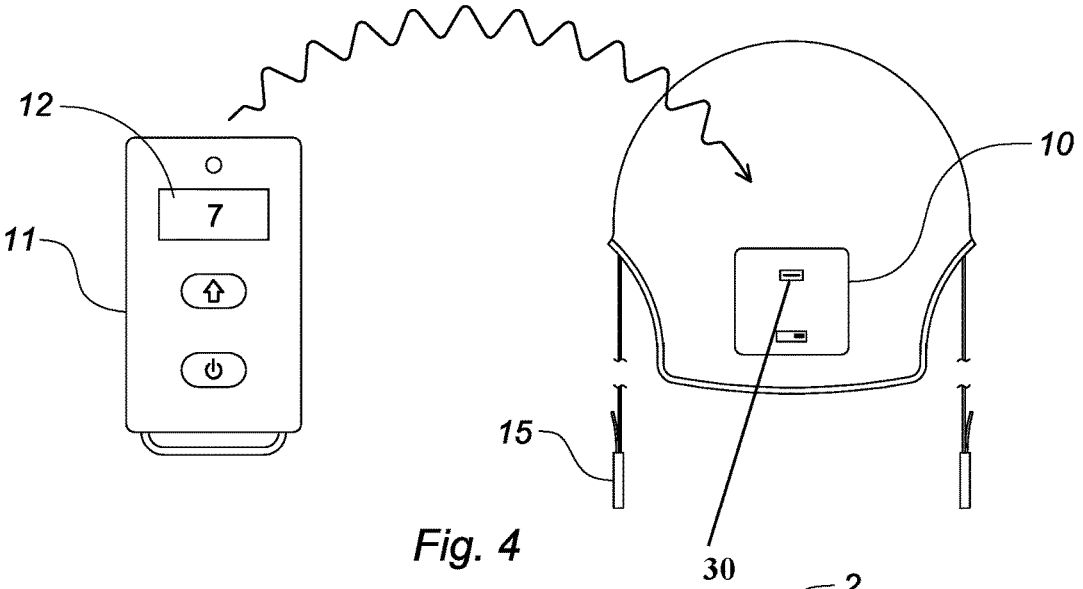
FIG. 4 is a rear view of the helmet depicting the battery pack and associated remote control.
Figure 5:
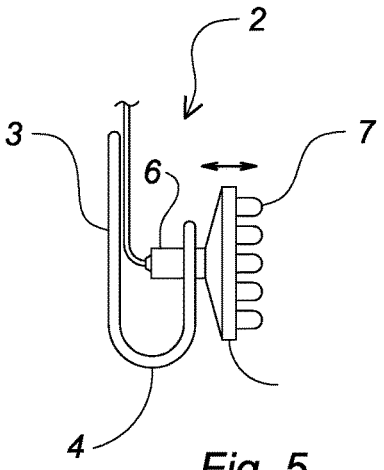
FIG. 5 is an isolated, side view of an exemplary massager.
Figure 6:
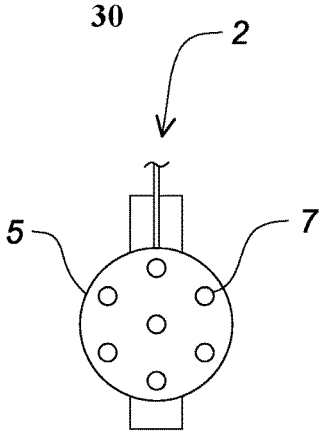
FIG. 6 is a front view of the massager.
Figure 7:
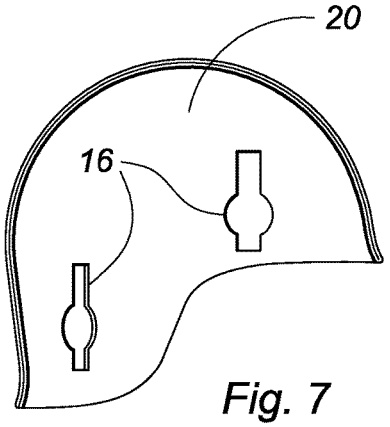
FIG. 7 is a plan view of an exemplary gel pack.

The present invention relates to a migraine helmet comprising a hollow, substantially-spherical shell 1 having an exterior surface, an interior surface that defines a head cavity, a face opening and a neck opening. On the interior surface of the shell are multiple massaging units 2 positioned to engage each of a wearer's temples and nape of the neck. In one embodiment, four units may be positioned so that one engages each temple and two engage portions of the nape, though the number and positioning can be varied.

Each massaging unit is formed of a J-shaped hanger 3 having a lower, upturned portion 4 that supports a motorized engagement disc 5 having a plurality of projections 7 on an outer surface. The hanger 3 is resilient but slightly flexible so that the engagement discs adjust to fit varying-sized heads. A linear-resonant actuator 6 vibrates the projections to simulate a manual massage. The actuator is connected to a power source within an electronics housing 10 mounted on the exterior surface of the shell, opposite the face opening. A programmable driver within the electronics housing controls the amount of voltage applied to the actuator to vary the vibration intensity of the projections. A receptacle 30 allows a user to recharge the power source when necessary.

A remote unit 11 is in wireless communication with the driver to allow a wearer to remotely adjust the vibration intensity of the actuator. A display 12 on the remote unit depicts the selected intensity level.

Attached to the interior surface of the shell are multiple patches of loop fasteners for mating engagement with any one of a plurality of freezable gel packs 20. Each gel pack is substantially hemispherical and is dimensioned and configured to completely overlay and conform to the inner surface of either half of the shell. The gel pack is formed of a polypropylene glycol gel enclosed within a hook-fabric casing that detachably adheres to the loop fasteners. Each gel-pack casing includes a pair of openings 16 that are configured to accommodate the hanger and disc. A separable chin strap 15 depends from each of two lower edges of the shell for securing the helmet to the wearer.

The above-described device is not limited to the exact details of construction and enumeration of parts provided herein. Finally, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A migraine helmet comprising:

a hollow, spherical shell having an exterior surface, an interior surface that defines a head cavity, a face opening and a neck opening;

a plurality of massaging units positioned on the interior surface of said shell, each of said massaging units including a hanger that supports a motorized engagement disc having a plurality of projections on an outer surface, and a means for vibrating said projections to massage a wearer's head;

multiple patches of hook-and-loop fasteners on the interior surface of said shell;

a pair of substantially hemispherical gel packs, each of said gel packs dimensioned and configured to completely overlay and conform to the inner surface of either half of said shell, each of said gel packs having strips of hook-and-loop fasteners thereon for mating engagement with said multiple patches of hook-and-loop fasteners on the interior surface of said shell, each of said gel packs further including an opening that is configured to accommodate both the hanger and the disc.

2. The helmet according to claim 1 wherein said gel packs comprise freezable gel packs removably attached to the interior surface of the shell for chilling a wearer's head.

3. The helmet according to claim 1 wherein said means for vibrating said projections to massage the wearer's head comprises a linear resonant actuator.

4. The helmet according to claim 3 wherein said actuator includes a control means for varying a vibration intensity of said projections.

5. The helmet according to claim 4 further comprising a remote unit in wireless communication with said actuator and said control means to allow a wearer to remotely adjust the vibration intensity of the linear resonant actuator.

6. The helmet according to claim 5 wherein said remote unit includes a display for depicting a selected intensity level.

7. The helmet according to claim 1 wherein said is hanger is resilient but slightly flexible so that said engagement disc adjusts to fit varying-sized heads.

8. The helmet according to claim 1 further comprising a separable chin strap depending from each of two lower edges of the shell for securing the helmet to the wearer.

* * * * *